United States Patent [19]

Russell

[11] Patent Number: 4,757,832

[45] Date of Patent: Jul. 19, 1988

[54] SELF-SUPPORTING OUTDOOR SLEEPING SYSTEM

[76] Inventor: Chesley G. Russell, 11003 Meadow Rue, The Woodlands, Tex. 77308

[21] Appl. No.: 852,786

[22] Filed: Apr. 16, 1986

[51] Int. Cl.[4] ..... E04H 15/44; E04H 15/36; E04H 15/02; A47C 29/00

[52] U.S. Cl. ..... 135/106; 135/96; 135/102; 135/104; 5/413; 2/69.5

[58] Field of Search ..... 5/413, 414; 2/69.5; 128/1 B; 135/103, 104, 91, 93, 117, 120, 102, 96, 98, 105, 106, DIG. 9

[56] References Cited

U.S. PATENT DOCUMENTS

| | | | |
|---|---|---|---|
| 23,582 | 4/1859 | John | 135/95 X |
| 713,329 | 11/1902 | Morton | 5/413 X |
| 730,877 | 6/1903 | Clapham | 5/413 X |
| 739,389 | 9/1903 | Castle | 135/117 X |
| 867,464 | 10/1907 | Abbott | 5/413 X |
| 924,733 | 6/1909 | Carswell, Sr. | 5/497 |
| 983,223 | 1/1911 | Fitch | 5/413 X |
| 1,039,509 | 9/1912 | Gail, Jr. | 135/96 X |
| 1,156,200 | 11/1915 | Ashworth et al. | 5/121 |
| 1,583,419 | 5/1926 | Perl | 5/413 X |
| 1,678,125 | 7/1928 | Petrescu | 2/69.5 |
| 1,699,002 | 1/1929 | Liebold | 5/413 |
| 1,887,108 | 11/1932 | Steese | 135/96 X |
| 1,919,154 | 7/1933 | Astrove | 5/413 X |
| 1,952,465 | 3/1934 | Rycroft | 5/413 X |
| 2,055,044 | 9/1936 | Nelson | 135/104 |
| 2,358,410 | 9/1919 | Matthesius | 5/413 X |
| 2,368,220 | 1/1945 | Hinds | 5/413 |
| 2,555,051 | 5/1951 | Miller | 2/69.5 |
| 2,581,357 | 1/1952 | Burstein | 2/69.5 X |
| 2,656,844 | 10/1953 | Kreuzer | 135/96 X |
| 2,963,715 | 12/1960 | Young | 5/497 |
| 3,158,299 | 11/1964 | Weir et al. | 5/113 X |
| 3,474,802 | 10/1969 | Loring | 135/104 |
| 3,751,741 | 8/1973 | Hendry | 135/104 X |
| 3,800,814 | 4/1974 | Hibbert | 135/104 X |
| 3,834,410 | 9/1974 | Leibel | 135/104 X |
| 3,860,980 | 1/1975 | Ebert | 5/416 |
| 3,970,096 | 7/1976 | Nicolai | 135/104 X |
| 3,971,495 | 7/1976 | Velazquez | 135/96 X |
| 4,068,674 | 1/1978 | Mitchell | 135/117 X |
| 4,072,158 | 2/1978 | O'Brien et al. | 135/116 |
| 4,106,145 | 8/1978 | Gillen et al. | 135/901 X |
| 4,124,908 | 11/1978 | Burns et al. | 2/69.5 X |
| 4,183,111 | 1/1980 | Zahavkochav | 5/413 |
| 4,232,692 | 11/1980 | Atkins | 135/102 |
| 4,236,543 | 12/1980 | Moss | 135/94 |
| 4,329,747 | 5/1982 | Russell | 5/481 X |
| 4,531,330 | 7/1985 | Phillips | 5/414 X |
| 4,605,029 | 8/1986 | Russell | 135/104 |

FOREIGN PATENT DOCUMENTS

| | | | |
|---|---|---|---|
| 2446622 | 8/1980 | France . | |
| 2454775 | 11/1980 | France . | |
| 2481589 | 6/1981 | France | 135/102 |
| 0031860 | 7/1981 | France . | |
| 610743 | 5/1979 | Switzerland . | |
| 1581786 | 12/1980 | United Kingdom . | |

*Primary Examiner*—Robert A. Hafer
*Assistant Examiner*—D. Neal Muir
*Attorney, Agent, or Firm*—Gunn, Lee & Jackson

[57] ABSTRACT

An outdoor sleeping system is provided incorporating a ground cover sheet to which is attached a tent cover in the form of a body section and a head section which are releasably interconnected by a slide fastener or other suitable connector. The tent cover is secured to the ground cover sheet by means of one or more slide fasteners enabling complete removal of the head and body portions of the tent cover or either of the head and body portions thereof as desired. The tent cover is constructed to permit efficient lateral or end entry into the sleeping system as is desired by the user under the conditions involved. Under wet conditions, lateral opening of the tent cover permits entry by the user while the tent cover prevents rain from getting into the sleeping system. The tent cover is supported in upright position by a plurality of ribs each of which being collapsible to a shortened condition for closure and rolling of the sleeping system. When rolled the sleeping system may be secured by means of compression straps. End covers, which may take the form of a frameless pack, are secured by compression straps to thus achieve protective enclosure and endwise compression of the rolled sleeping system. The sleeping system may also include a thermally protective comforter in the form of a single or double thickness having end extensions which may be used as a pillow or thermal protection by the user. The sleeping system also includes a removable sheet structure capable of being assembled to the ground cover sheet and securing a mattress pad in immovable relation relative thereto.

18 Claims, 3 Drawing Sheets

FIG. 1
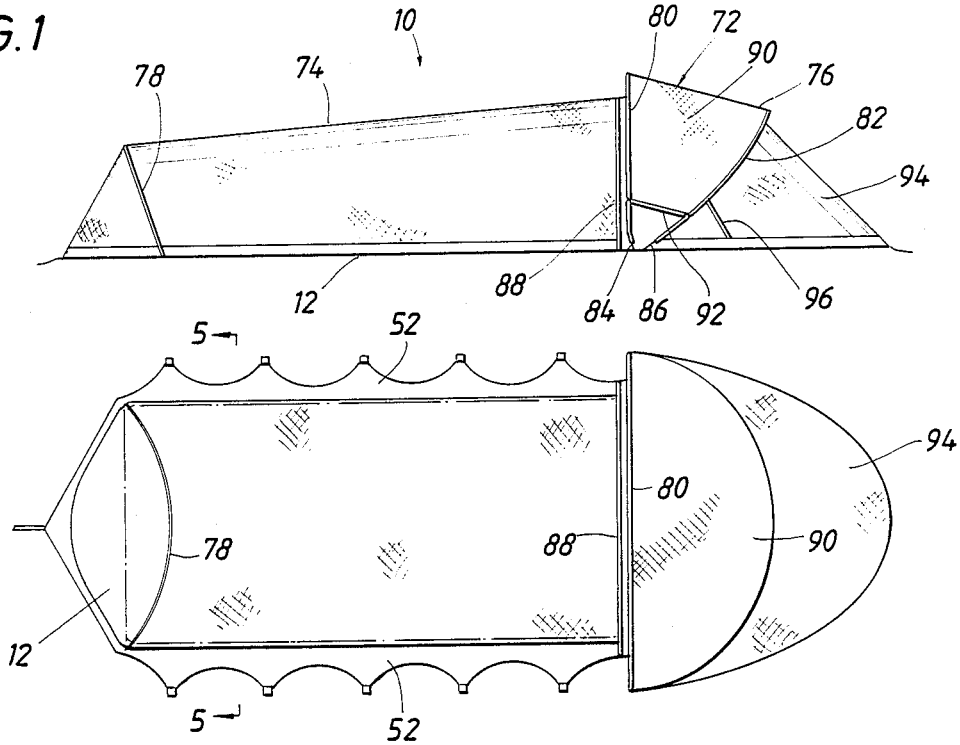
FIG. 2
FIG. 3
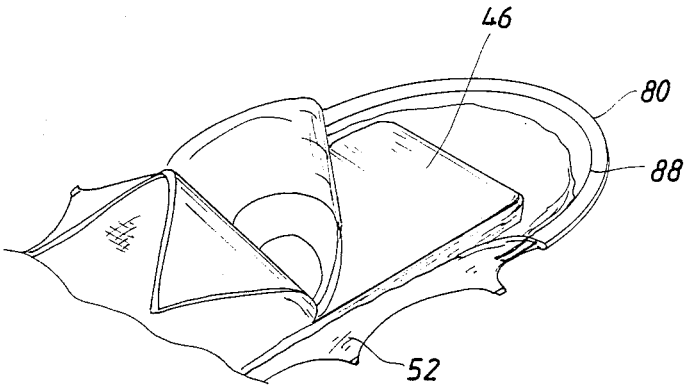
FIG. 4
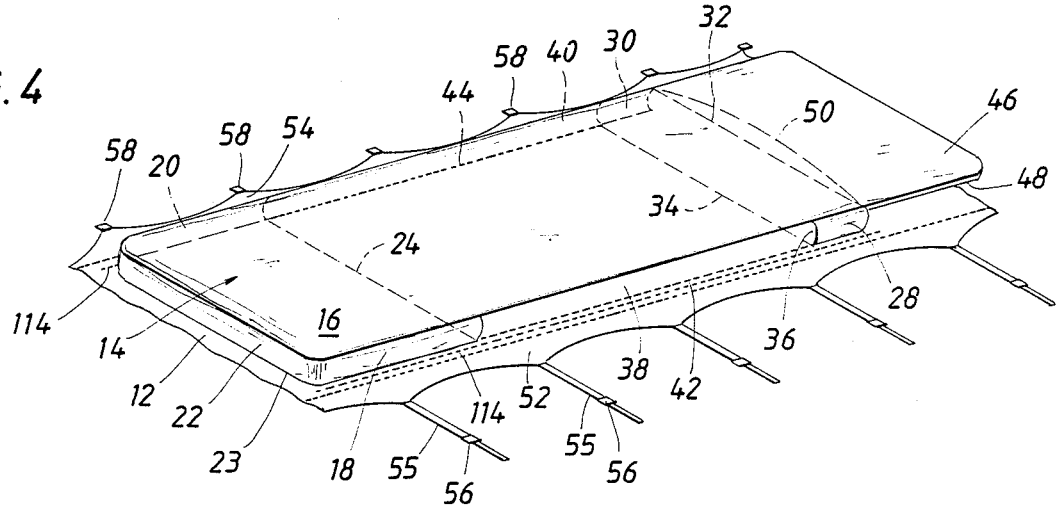

FIG. 5
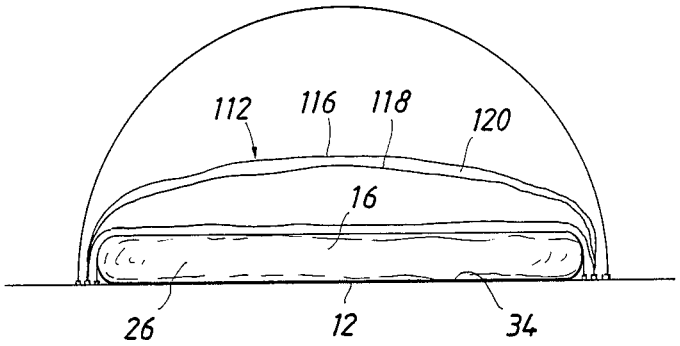
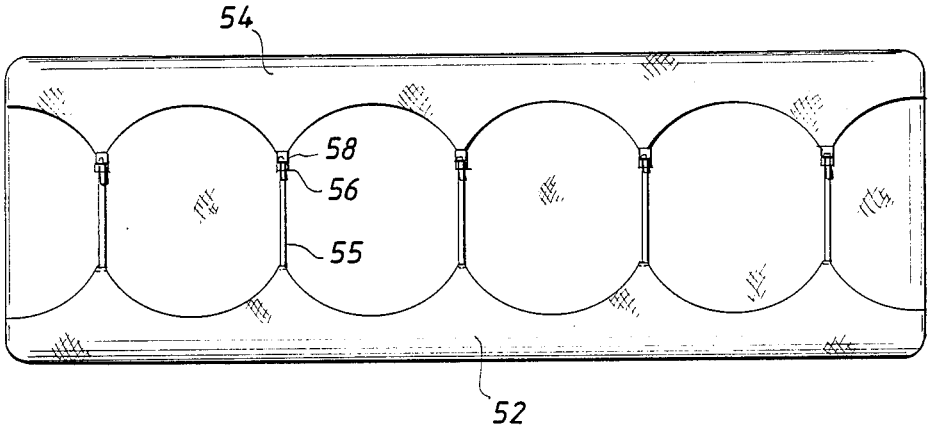
FIG. 6
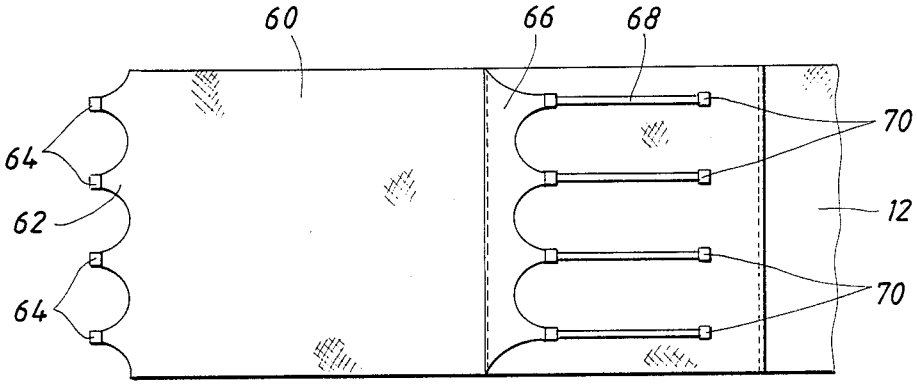
FIG. 7
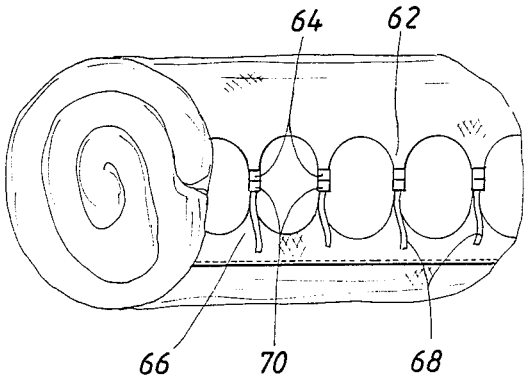
FIG. 8

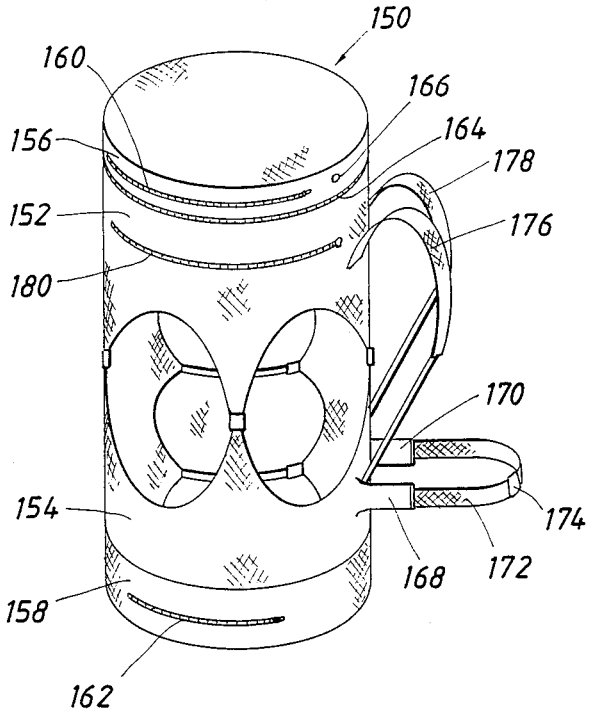
FIG. 12
FIG. 11
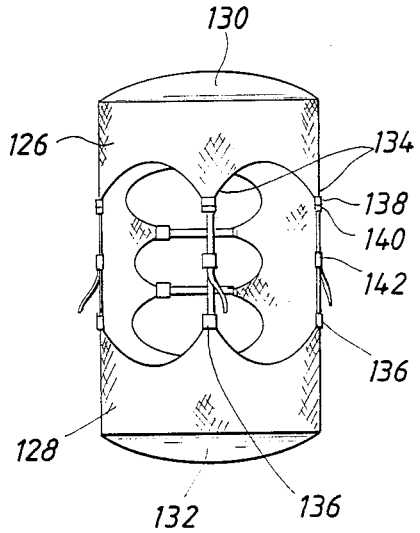
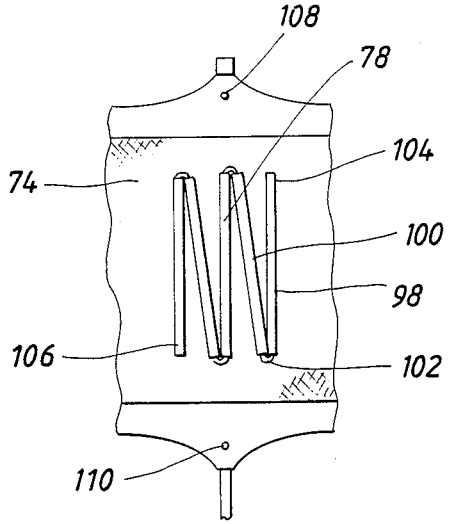
FIG. 9
FIG. 10
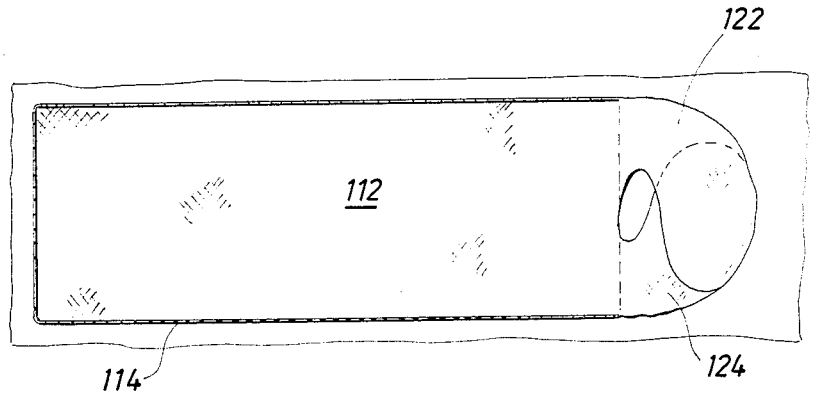

SELF-SUPPORTING OUTDOOR SLEEPING SYSTEM

RELATED INVENTIONS

This invention relates generally to the subject matter of U.S. Pat. Nos. 4,329,747 and is a continuation-in-part of the subject matter of application Ser. No. 586,746 now U.S. Pat. No. 4,605,029 filed by Chesley G. Russell on Mar. 6, 1984 and entitled "Self-Supporting Outdoor Sleeping System".

FIELD OF THE INVENTION

This invention relates generally to outdoor sleeping equipment such as tents, sleeping bags, sleeping supports, etc., and more specifically concerns a sleeping system for use by one or two persons and which includes a protective ground cover, protective support pad, temperature control liner and a protective cover or tent enabling the user to remain comfortable in a wide variety of environmental conditions.

BACKGROUND OF THE INVENTION

A large number of people enjoy outdoor sports such as hiking, backpacking, camping, hunting and fishing, etc., where extended periods of time are spent in an outdoor environment, being subjected to a wide variety of environmental conditions. In many cases, tents and other types of portable shelters are utilized to provide comfort and protection from the effects of certain environmental conditions. In many cases where outdoor activities are enjoyed in remote locations, the equipment involved is desired to be sufficiently light and portable that it can be transported by the user such as by means of a backpack, pack animal, etc. It is to such lightweight and portable camping and sleeping facilities that the present invention is directed.

SUMMARY OF THE INVENTION

Briefly, a protective sleeping system according to this invention takes the form of a combination moisture impervious ground cover, mattress, sleeping bag and tent or bivy cover that provides efficient protection and comfort in a wide variety of outdoor conditions. Further, the system is of extremely lightweight nature and may be efficiently rolled to a very small size to enable its portability such as for backpacking activities, etc. The sleeping system incorporates a ground cover sheet which is impervious to moisture. The ground cover sheet incorporates a protective casing panel having a connector means such as a plurality of straps connected thereto. When rolled to a small size, the protective casing panel forms an outer protective layer for the sleeping system and the connector means or straps completely encircle the rolled sleeping system to thus secure it in rolled condition.

The sleeping system may also incorporate a removable sheet which is releasably secured by slide fasteners or the like to the ground cover sheet. The removable sheet device is capable of being cleaned separately from other components of the sleeping system thus enabling efficient maintenance of clean bedding. The removable sheet device also defines pockets beneath each extremity thereof for receiving respective end portions of a mattress pad of the sleeping system. The pad provides a protective cushion to thus render the sleeping system comfortable to the user even under use in fairly rough terrain. An extension at one end of the removable sheet device may define a pillow pocket to be stuffed with articles of clothing etc. to provide a pillow if desired by the user.

For further protection and comfort of the user, the sleeping system incorporates a peripheral slide fastener strip which is secured to the ground cover sheet and provides for attachment of a thermal liner about the removable sheet device and its rectangular pad. The liner is used for thermal protection of the user and may be of any suitable weight and thermal character to provide ample protection for the user in the range of temperature conditions that is expected. The thermal liner is provided with spaced extensions at the head end thereof enabling the extensions to be wrapped or connected snugly about the head of the user to minimize body heat loss or beneath the head of the user to serve as a pillow.

Also secured to the ground cover sheet is a tent or bivy cover structure. The tent is releasably connected along at least one side and along the lower end of the ground cover sheet and along the opposite side and head portions of the ground cover sheet by means of one or more slide fastener connections. The slide fastener arrangement for the tent is such that ground water will not enter the tent and rain water trickling downwardly will be shielded from the slide fastener by a rain flap. This feature allows at least one side and one end of the tent or bivy cover to be released from the ground cover sheet to enable it to flex to an open condition along the side portion to thus enable the user to have efficient lateral access for ingress and egress and to have protected ingress and egress during rain.

The tent cover of bivy cover of the sleeping system defines a body portion extending about to the shoulders of the user and a head portion extending from the body portion to the head extremity of the ground cover sheet. The head portion and body portion of the bivy cover are connected to the ground cover sheet by separate slide fasteners enabling either the head portion or the body portion or both the head and body portions to be simply and efficiently removed from the ground cover sheet. This feature enables the user to rest comfortably in the sleeping system with the bivy cover partially or completely removed. For example, if the sleeping system is used while inside a larger tent or other protective enclosure, the tent cover would not be necessary and can be removed.

The tent cover defines a plurality of rib receptacles disposed in spaced relation along the length thereof. Flexible ribs are received by each rib receptacle and are disposed in flexed, upstanding relation maintaining the tent cover in spaced relation with the ground cover sheet and other components making up the mattress or floor portions of the sleeping system.

In its open condition, the flexible rib elements maintain the tent cover taut even though it is released from the ground cover sheet along its side portion. This enables the tent to shed rain and enables the user to enter and exist the tent from the side while the tent, being supported by the ribs, protects the liner and pad structure from rain.

The sleeping system defines a body portion and a head or hood portion which are releasably interconnected such as by means of a slide fastener. The hood portion of the bivy cover at the head portion thereof includes air vent means, the effective size of which can be efficiently controlled by the user to facilitate as much ventilation as is desired for comfort. The enlarged head portion of the sleeping system is also provided with protective flaps which prevent rain from entering the vent openings and also assists in maintaining the taut self-supporting condition of the tent structure.

The head portion of the sleeping system is also provided with an insect cover and a protective flap which are both secured to the ground cover sheet by means of slide fasteners. This feature enables the head portion of the tent to be completely open when desired for adequate ventilation during warm conditions. The head cover flap also provides protection against rain. The head portion of the ground cover sheet may also be provided with a pocket into which may be stuffed clothing, thermal liners, etc., to thus form a pillow for the reclining comfort of the user. This pocket will be employed as a pillow only when the pillow pocket of the removable sheet unit is not in use.

The head portion of the tent cover is provided with at least one and preferably a pair of spaced rib receptacles each with a rib for supporting the head portion in upright condition. One of the rib member is located at the juncture of the body portion and head portion of the tent cover. The lower portions of the ribs are disposed in pivotal relation with the ground cover sheet and thus, while flexed to an arched condition, are pivotal to a nearly horizontal position as the head portion of the tent cover is collapsed toward the head extremity of the ground cover sheet. Preferably, the ribs of the head portion of the tent cover are disposed in upwardly diverging relation with the respective end portions thereof spaced closed together. During collapsing of the head portion of the tent cover, both of the ribs are pivotal from an upstanding position to a nearly horizontal position. This enables the user to release the head portion of the tent cover from the body portion, collapse the head portion and then enter the sleeping system from the head end thereof. After so entering, the user will simply raise the head portion of the tent cover and reconnect the head and body portions such as by means of the slide fastener.

Both the head and body portions of the tent cover may be provided with slide fasteners or other suitable connectors, enabling them to be completely removed from the ground cover sheet. Transverse spreader ribs may also be employed to stabilize the tent support ribs of the hood, thus permitting the hood to stand even when disconnected from the tent.

Each of the flexible ribs is defined by a plurality of rib sections, each being of tubular form and having a bungie cord or other stretchable retainer element extending therethrough and maintaining the various sections in assembly. By separating the sections of the ribs and folding them, collapsed rib assemblies are formed which are of less length than the width of the sleeping system. Thus, the ribs may be maintained in interconnected relation with the rib receptacles of the tent cover to facilitate ease and speed of setting up and dismantling the sleeping system. Further, since the ribs are retained in assembly with the rib receptacles, none of the parts thereof can become lost or misplaced.

When the sleeping system is rolled to a tight, rolled form, end compression members are provided which are interconnected by a plurality of adjustable straps. By adjusting these straps, the length of the rolled sleeping system may be efficiently compressed lengthwise to minimize the bulk thereof. The end compression covers of the sleeping system may incorporate pockets for supporting articles when the sleeping system is being transported. Further, the end compression caps may be provided with pack straps, enabling the rolled and compressed sleeping system to be strapped onto the user in the form of a backpack. In such condition, a frameless backpack is provided, the rolled sleeping system representing a structural component thereof.

For controlling the comfort of the user, liners or insulated sheets of various weight may be installed within the sleeping in covering relation with the sheet or mattress pad such as by means of slide fasteners or any other suitable form of releasable connection.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiment thereof which is illustrated in the appended drawings.

It is to be noted, however, that the appended drawings illustrate only a typical embodiment of this invention and are therefore not to be considered limiting of its scope, for the invention may admit to other equally effective embodiments.

IN THE DRAWINGS

FIG. 1 is an elevational view of a self-supporting portable outdoor sleeping system constructed in accordance with the present invention.

FIG. 2 is a plan view of the sleeping system of FIG. 1.

FIG. 3 is an isometric illustration of the head portion and part of the body portion of the sleeping system of FIGS. 1 and 2, illustrating the collapsed condition of the head portion to permit ingress and egress from the end of the sleeping system.

FIG. 4 is an isometric illustration of a major portion of the sleeping system of FIGS. 1–3 showing the ground cover sheet with a removable pocketed sheet and mattress pad in assembly therewith, the comforter and tent cover being removed to facilitate ready understanding thereof.

FIG. 5 is a sectional view of the sleeping system taken along line 5—5 of FIG. 2.

FIG. 6 is a plan view of the sleeping system of FIGS. 1–5 being shown in the collapsed and laterally compressed condition thereof in readiness for rolling.

FIG. 7 is a partial bottom view of the ground cover sheet of the sleeping systems of FIGS. 1 and 2, illustrating the self-contained stuff sack or protective enclosure and rolled compression straps thereof.

FIG. 8 is an isometric view illustrating the sleeping system of FIGS. 1 and 2 in the rolled condition thereof and secured by means of the roll compression straps of FIG. 6.

FIG. 9 is a partial plan view of the sleeping system of FIGS. 1 and 2 in the collapsed position thereof and illustrating one of the multisection ribs thereof in the disassembled and folded condition ready for rolling of the sleeping system.

FIG. 10 is a plan view of the bedding portion of the sleeping system of FIGS. 1 and 2 illustrating a comforter attached to the ground cover sheet or pad cover by means of a slide fastener or the like and showing overlapped head portions thereof forming a pillow or a thermal head cover or the head of the user.

FIG. 11 is an elevational view of a protective end cap enclosure shown disposed about a rolled sleeping system capable of endwise compression of the rolled sleeping system.

FIG. 12 is an isometric illustration of a frameless pack system embodying protective compression caps for containing and compressing the rolled sleeping system and providing end pockets for storage of other articles.

DETAILED DESCRIPTION OF PREFERRED EMBODIMENT

Referring now to the drawings and first to FIG. 1, a portable, self-supporting sleeping system is illustrated generally at 10 which is shown in its assembled and upstanding condition such as during use. As shown particularly in FIGS. 1, 2, and 4 the sleeping system incorporates a ground cover sheet 12, the bottom panel 16 of the ground cover sheet being shown in FIG. 6. The ground cover sheet is of generally rectangular form and is composed of a durable but lightweight fabric material which is lined with a water impervious sheet material of any suitable character. Since this sleeping system will often be positioned in contact with damp earth, grass, etc., it is important that moisture be prevented from penetrating the ground cover sheet and being transmitted by osmosis through the protective bedding material within the sleeping system.

It is desirable to provide the sleeping system hereof with means for insuring the comfort of the user even when the sleeping system is resting on rather rough ground. It is also desirable to provide means for insuring the capability of efficiently cleaning the bedding of the sleeping system without necessitating cleaning the entirety thereof. As shown in FIG. 4 these features are realized by a removable sheet unit which is illustrated generally at 14. The removable sheet unit incorporates an upper, generally rectangular elongated sheet panel 16 composed of a soft fabric material such as linen. If desired, this panel may also be composed of an insulated sheeting material thus, in the case of cold weather conditions, providing the user with additional thermal protection. Beneath the foot end of the elongated sheet panel 16 is provided a pad pocket defined by a pair of side walls 18 and 20, a bottom wall 21 and an end wall 22. At the forward end of the pocket, a pocket opening 24 is defined which receives the foot portion of a pad member 26. The pad member 26 may be formed of any suitable porous foam material such as polyfoam or any other suitable pad material without departing from the spirit and scope hereof. In light weight sleeping systems of this nature it is desirable that the material of the pad be of very light weight construction and that it be capable of being rolled to a rather highly compressed form and capable of returning to its normal thickness and resiliency upon being unrolled. If desired, the pad 26 may conveniently take the form set forth in applicant's prior U.S. Pat. No. 4,329,747.

Beneath the opposite end of the sheet panel 16 is defined another pad pocket which is formed by sheet material and defined by side portions 28 and 30 and end portion 32 and a bottom wall 34. This pocket defines an opening 36 capable of receiving the head end of the pad member 26. As mentioned above, the opposite end of the pad is extended through opening 24 into the pocket at the foot portion of the removable sheet unit 14. Thus, the pad member is at least partially encapsulated within pockets defined by the removable sheet unit and is therefore secured in position within the sleeping system such that it cannot shift either laterally or linearly when the sleeping system is being used or is being rolled or otherwise handled. At opposed side portions of the removable sheet unit are provided a pair of retainer panels 38 and 40 which extend laterally from the upper panel 16. The retainer panels 38 and 40 are provided with fastener connections enabling them to be releasably secured to the ground cover sheet 12. If desired, the fasteners may conveniently take the form of slide fasteners 42 and 44. To remove the sheet unit and the pad 26, the user merely releases the slide fasteners or other type fasteners at the side portions of the retainer panels. After this has been done, the sheet unit and pad, in assembly therewith, are loose and may be removed from the interior of the sleeping system as a unit. If the sheet unit or pad may have taken on moisture such as perspiration from the body of the user, it may simply be removed from the pockets of the sheet structure for drying. The sheet unit may be cleaned in any suitable manner, such as by washing and drying, to insure its cleanliness. Thereafter, with the sheet unit disassembled from the sleeping system, the pad is installed with the end portions thereof located within the respective end pockets. The pad and sheet unit may then be positioned within the sleeping system and the fasteners of the retainer panels assembled to thereby secure the sheet unit and pad in substantially immovable relation within the confines of the sleeping system.

To minimize the weight of the sleeping system a head end portion 46 of the elongated sheet panel 16 extends beyond the head end of the pad. The pad is typically of sufficient length only to support the user from the feet to the shoulders. A lower panel 48 is secured at the periphery thereof to the periphery of the sheet extension 46 so as to define a pillow case having an opening 50. As suits the comfort of the user various articles, such as clothing, may be inserted through the opening 50 into the pillow pocket, thereby forming a pillow for the head of the user. When the sleeping system is to be rolled with the pillow empty, the pillow is folded back over the top of the sheet panel 16 and rolled along with the sleeping system.

The opposed side portions of the ground cover sheet defines lateral compression panels such as shown at 52 and 54. Each of the compression panels is scalloped at the edge portions thereof and compression connector straps 54 extend therefrom and are provided with buckles 56 at end portions of the compression straps. On the opposite side of the sleeping system, compression panel 54 is also scalloped and is provided with connective buckles 58 which are received by the buckles 56 of the strap 55. As shown in FIG. 6, the compression panels and straps are folded over the collapsed tent portion of the sleeping system and the buckles of the compression straps are secured and tightened to maintain the sleeping system under lateral compression during rolling thereof.

With the sleeping system in the laterally compressed state illustrated in FIG. 6, it then may be rolled lengthwise and secured in rolled compression in the manner shown in FIG. 8. As shown in FIG. 7 the bottom view shows the ground cover sheet 12 to include a protective panel 60 of generally rectangular form. It is to be understood that the ground cover sheet may be a single integral sheet member defining the entire length of the sleeping system or it may comprise an assembly with a protective panel of a different type of fabric. In the case where a protective panel extends from the ground cover sheet, the protective panel is at the head portion of the sleeping system since the sleeping system is ordinarily rolled from the bottom or foot portion thereof. Such is not intended to be limiting with regard to this invention, it being within the spirit and scope hereof that the protective panel may be located at the foot portion of the sleeping system as well.

The protective panel 60, while being composed of a moisture impervious material, is also constructed of a heavy duty protective fabric such as heavywater proofed canvas or any combination of laminated fabric sheets. In fact, the protective panel may be in the form of an additional exterior panel secured as an outer layer to the bottom surface of the ground cover sheet 12. Rolling of the sleeping system is begun at the end opposite the location of the protective panel 60. When the sleeping system is completely rolled, the protective panel becomes the outer cover of the rolled sleeping system. The protective panel 60 is therefore referred to as a self-stuffing stuff sack for the sleeping system. At the free extremity of the protective panel 60 is provided a compression portion 62 which is scalloped and is provided with a plurality of buckles 64. Intermediate the length of the protective panel 60 is provided a compression panel 66 which is also of scalloped form. A plurality of compression straps 68 extend from the compression panel 66, the straps being provided with adjustable buckles 70. With the buckles 70 loosely adjusted, the sleeping system is rolled until the buckles are enabled to be interconnected with mating buckles 64. When this is done, the compression straps 68 are then tightened as desired to provide circumferential compression about the rolled sleeping system. By systematic application of force to the compression straps the rolled sleeping system may be compressed to a very small diameter roll. Typically, this is accomplished by the user who kneels on the rolled sleeping system placing it under mechanical force while simultaneously and systematically tightening the compression straps.

Referring now again to FIGS. 1 and 2, the sleeping system 10 defines a tent cover illustrated generally at 72 which is defined by a body portion 74 and a head portion or hood 76. As mentioned above, both the head and body portions of the tent cover are secured to the ground cover sheet of the sleeping system. If desired, the end and one side portion of the tent cover body may be connected to the ground cover sheet by sewing while the opposite side may be connected to the ground cover sheet by means of an elongated slide fastener or any other suitable form of fastening. This feature permits opening of the tent cover in lateral manner to allow lateral ingress and egress by the user. Preferably the head portion of the tent cover is sewn to the ground cover sheet 12; however, all or part of the lower edge of the body portion of the tent cover may be connected to the ground cover sheet by means of one or more slide fasteners or the like. This feature permits lateral opening or removal of the head portion and/or the body portion of the tent cover in its entirety if such is desired. Likewise, the lower edge of the head portion of the tent cover may be partially sewn to the ground cover sheet if desired to permit lateral opening of the head position. The lower edge of the head portion of the tent cover may be secured to the ground cover sheet by means of one or more slide fasteners or fastening means of any other suitable character. This feature permits complete removal of the head portion of the tent cover from the ground cover sheet as desired for the comfort of the user. In the event the user is in an environment where a larger tent is provided or any other suitable form of overhead shelter is available, or if the tent cover is without the tent cover being attached thereto. The sleeping system is therefore readily adapted for use in any number of differing environments under the control of the user.

It is desirable to maintain the tent cover including the head and body portions thereof in rather taut, upright position so that the tent cover is always in spaced relation with the body and bed clothing of the user. This prevents the bed clothing from becoming dampened by moisture that might collect on the inner surface of the tent cover. The taut and upright tent cover is supported by means of a plurality of flexible ribs as shown in FIGS. 1 and 2. A rib receptacle 78, which may be in the form of a grommet, is provided at the foot portion of the tent. An elongated flexible rib member is positioned within the receptacle 78 with end portions thereof located within grommets or other suitable end receptacles affixed to the ground cover sheet. Within the tent portion 76 of the tent cover a pair of rib receptacles 80 and 82 are provided, each having a flexible rib member 84 and 86 in assembly therewith. Respective end portions of the flexible ribs 84 and 86 are received by grommets or other receptacles of the ground cover sheet 12 to thus stabilize the ribs relative to the ground cover sheet and tent cover. As shown in FIG. 1, the respective rib receptacles 80 and 82 and the ribs contained therein are disposed in upwardly diverging relation. Rib receptacle 80 and its rib 84 is located near the juncture between the body portion 74 and the head portion 76 of the tent cover, such juncture being defined by a slide fastener 88 or other suitable form of releasable connection. Positioning of the lower extremities of the rib members 84 and 86 in closely spaced relation permits pivoting of the head portion 76 of the tent cover from the upstanding position shown in FIGS. 1 and 2 to a collapsed position shown in the isometric view of FIG. 3. In the collapsed postion, the rib members have each pivoted from the upstanding position therof to nearly horizontal position as the material of the head portion of the tent cover is collapsed toward the head end of the sleeping system. When so positioned, the user is enabled to enter the sleeping system from the head end thereof while the side portions of the body of the tent cover remain firmly secured to the ground cover sheet. After the user has so entered the sleeping system and is resting on the pad thereof, the user simply grasps the forward part of the head portion of the tent cover, such as at the rib receptacle 80. The head portion of the tent cover is then pivoted to its upstanding position as shown in FIG. 1 after which the slide fastener may be appropriately manipulated to securely fasten the head and body portions of the tent cover. The slide fastener 88 is protected against entry of moisture by a suitable rain flap and by the overlying nature of the arcuate panel 90. If desired, transverse rib members 92 may be received within appropriate rib receptacles on either side of the head portion of the sleeping system and may serve to maintain the ribs 84 and 86 in the diverging relation shown in FIGS. 1 and 2. When such transverse ribs are employed, the panel 90 of the head portion of the sleeping system will maintain its shape even when the sleeping system is partially collapsed. In such case, the forward panel 94 at the head portion of the sleeping system will collapse and the panel 90 will remain substantially rigid by virtue of the relationship of ribs 84, 86 and 92. If desired, other transverse ribs may be employed such as shown at 96 which, together with transverse ribs 92 and arcuate ribs 84 and 86, will allow the head portion of the sleeping system to remain upright and stable even under circumstances where the body portions 74 of the tent cover is completely removed in the manner described above.

As shown in FIG. 9, each of the rib members are of multijointed character with a central section thereof being located within a rib receptacle defined by the tent cover. The rib members are composed of lightweight, flexible tubular material in the form of individual sections as shown at 98 and 100. A length of bungie cord 102 or other flexible material is extended through the tubular sections of the rib members and is secured at the respective ends of the rib members. By simply pulling apart the connections of the rib sections by stretching the bungie cord material, the rib sections are released and may be folded to the position shown in FIG. 9 such that the overall length of the rib members in folded condition is substantially less than the width of the laterally compressed sleeping system as shown in FIG. 6. Thus, the jointed ribs, always remain in assembly with the tent cover portion of the sleeping system and are always located at the proper positions for ease of assembly. The ribs are joined by simply joining the connectors of the various rib sections to form a single integral elongated rib member. It is then bent to a curvature suitable to position the respective end portions 104 and 106 thereof within respective rib receptacles or grommets 108 and 110. The various sections of the rib members will not become misplaced or inadvertently separated from the sleeping system since they remain interconnected by the bungie cord. Moreover, the sections are always properly positioned for ease of assembly and are properly located so that the user may easily set up the sleeping system even under conditions of poor light such as at night.

Referring now to FIG. 9, it will be desirable to provide the sleeping system with suitable thermal insulation as required by the outdoor environment to be encountered. This feature is effectively provided by means of a thermal comforter 112 which is secured by one or more slide fasteners 114 or other suitable connectors to the ground cover sheet or to the sheet structure 14 shown in FIGS. 5 and 10. The edge portion of the comforter 112 is provided with a mating portion of the slide connector and is simply and efficiently secured within the sleeping system over the sheet and pad structure of FIGS. 5 and 10.

The comforter is formed by upper and lower sheet members 116 and 118 with a filler 120 of thermal insulation interposed therebetween as shown in FIG. 5. The comforter may be quilted in order to secure the components thereof in substantially immovable relation even under circumstances where the comforter is subjected to rough handling such as during cleaning. In the alternative, the comforter may be in the form of a sleeping bag of double thickness with two thermally insulated layers, one forming a thermal layer beneath the user and the other forming a thermal layer over the user. Under extremely cold conditions the comforter will be quite thick and will provide effective protection for the user at temperatures well below zero degrees F. At the head portion of the comforter a pair of lateral extensions 122 and 124 are provided which are each of generally L-shaped configuration. These lateral extensions are capable of being overlapped and secured in assembly to thus form a double layer thickness serving as a pillow for the head of the user. Under extremely cold conditions the lateral extensions 122 and 124 of the comforter may be wrapped about the head of the user to provide efficient thermal protection.

Referring now to FIGS. 8 and 11, with the sleeping system in the rolled condition thereof as shown in FIG. 8, it may be desirable to provide additional lateral compression to minimize the length thereof and it may also be desirable to provide the rolled sleeping system with additional protection at the side portions thereof. Accordingly, as shown in FIG. 11, a pair of end caps 126 and 128 are provided, each being defined by a generally cylindrical skirt portion sewn or otherwise connected to circular end portions 130 and 132 respectively. The cylindrical skirt portions 126 and 128 are scalloped and define a plurality of scalloped extensions such as shown at 134 and 136. The scalloped extensions of one of the end caps is provided with buckle members 138 which are received by connector buckles 140 which are adjustably provided on compression straps 142 secured to the scalloped extensions 136 of the opposite end cap. With the sleeping system rolled as shown in FIG. 8, the end caps are positioned on opposite ends of the roll as shown in FIG. 11. The buckles 138 and 140 are secured in assembly, after which the compression straps are tightened to thus force the end caps 126 and 128 toward one another. When this occurs the rolled sleeping system is placed under lateral compression and the overall length thereof may be substantially shortened.

As shown in FIG. 12, an arrangement similar to that of FIG. 12 may conveniently take the form of a frameless pack which may be worn by the user. The frameless pack, shown generally at 150, includes end caps 152 and 154 which are defined by cylindrical skirts with circular end portions in the manner shown in FIG. 12. The end caps 152 and 154 are secured in compression about the rolled sleeping system by means of straps and buckles of the same character shown and described in connection with FIG. 11. Additionally, the end caps 152 and 154 may be provided with end pockets 156 and 158 such as might contain articles that might be useful when the system is being worn as a backpack. The pockets 156 and 158 may be provided with slide fastener type openers as shown at 160 and 162 or in the alternative, may be provided with enclosure devices of any other suitable character. Also, if desired, one or both of the pack pockets 156 and 158 may be releasable from the pack such as by means of a slide fastener 164 or other suitable connector. If such as the case, the pocket member 156 may be provided with strap connectors 166 enabling it to be transported by means of an over-the-shoulder strap or other suitable handle.

The lower end cap 54 is provided with hip straps 168 and 170 with appropriate adjustable straps and buckles 172 and 174 interconnected therewith to enable securing of the pack to the hips of the user. Shoulder straps 176 and 178 are also provided which are connected to the respective upper and lower end cap. With the shoulder straps and hip straps employed, the rolled and compressed sleeping system may be worn as a backpack and other implements of a packing trip may be located within the end pockets of the pack system. Obviously the pack system may be provided with other devices such as side pockets, external tie straps, etc. Within the spirit and scope of the present invention. In the case of rainy conditions, a slide fastener 180 may be provided to permit a rain flap to be easily secured to the exterior of the pack thereby precluding entry of moisture therein.

It is therefore seen that this invention is one well adapted to attain all of the objects and advantages hereinabove set forth together with other advantages which will become obvious and inherent from a description of the apparatus itself. It will be understood that certain combinations and subcombinations are of utility and may be employed without reference to other features and subcombinations. This is contemplated by and is within the scope of the present invention.

As many possible embodiments may be made of this invention without departing from the spirit or scope thereof, it is to be understood that all matters hereinabove set forth or shown in the accompanying drawings are to be interpreted as illustrative and not in a limiting sense.

What is claimed is:

1. A self-supporting outdoor sleeping system comprising:

(a) ground cover sheet means forming a head end and a foot end and defining a moisture impervious floor;

(b) a fabric tent cover forming a tapered body portion and an oppositely tapered head portion attached to peripheral edges of said ground cover sheet means, at least one side of said tent cover being releasable from said ground cover sheet means to facilitate selective lateral ingress and egress of the user, said tent cover defining spaced rib receptacle means at least one of which being located at the juncture of said body portion and head portion;

(c) a plurality of flexible rib members being received by respective rib receptacle means and supporting said tent cover in spaced relation with said floor;

(d) fastener means releasably securing said body portion and said head portion of said tent cover in assembly, upon release of said fastener means, said head portion of said tent cover folding to a collapsed position at the head end of said ground cover sheet means and said rib means at the juncture of said body portion and head portion being pivotal in flexed condition from an upstanding position to a near horizontal position during collapsing of said head portion of said tent cover, thus permitting selective endwise ingress and egress of the user; and (e) a pair of said rib receptacle means are defined by said head portion of said tent cover means with end portions thereof at each lower side of said head portion located close together, said rib receptacle means diverging upwardly, thus positioning said rib means thereof in upwardly diverging relation when said head portion is in the upstanding position thereof and defining an arcuate panel therebetween, said arcuate panel extending above the highest level of said body portion of said tent cover.

2. A self-supporting outdoor sleeping system as recited in claim 1, wherein:

one of said rib means is located intermediate the length of said head portion of said tent cover and is of lesser length than said rib means at the juncture of said head and foot portions of said tent cover thereby defining an arch of smaller diameter in the flexed condition thereof, said head portion of said tent cover being tapered from the juncture of said head and foot portions of said tent cover to the head end of said ground cover sheet means.

3. A self-supporting outdoor sleeping system as recited in claim 2, wherein:

both of said upwardly diverging rib means are pivotal in the flexed condition thereof from an upstanding position to a nearly horizontal position relative to said ground cover sheet means during collapsing of said head portion of said tent cover.

4. A self-supporting outdoor sleeping system as recited in claim 1, wherein:

at least one end of at least one of said rib means is received in releasable connection with said tent cover at said releasable side thereof, upon release of said one side of said tent cover from said ground cover sheet means, said at least one of said rib means supporting the intermediate portion of said tent cover in elevated position above said ground cover sheet means forming a lateral opening with said ground cover sheet means, said ground cover sheet means being protected from rain by said elevated intermediate portion of said tent cover for rain protected lateral ingress and egress of the user.

5. A self-supporting outdoor sleeping system as recited in claim 1, wherein:

fastener means releasably secures said head portion of said tent cover to said ground cover sheet means, whereby said head portion of said tent cover is removable from said sleeping system.

6. A self-supporting outdoor sleeping system as recited in claim 1, wherein:

fastener means releasably secures said body portion of said tent cover to said ground cover sheet means, whereby said body portion of said tent cover is removable from said sleeping system.

7. A self-supporting outdoor sleeping system as recited in claim 1, wherein:

slide fastener means releasably secures said tent cover and ground cover sheet means in releasable assembly, providing selective release and removal of body portion and said head portion of said tent cover from said ground cover sheet means.

8. A self-supporting outdoor sleeping system as recited in claim 7, wherein:

said head portion of said tent cover is supported in upstanding position by said rib means even when said body portion of said tent cover is separated therefrom.

9. A self-supporting outdoor sleeping system as recited in claim 1, wherein:

(a) lateral compression sheet means extend from opposed side edge portions of said ground cover sheet means and along substantially the entire length of said ground cover sheet means; and (b) a plurality of compression straps extend from said lateral compression sheet means in spaced relation along the length thereof and are adjustably connected in the collapsed condition of said tent cover to place the collapsed sleeping system under lateral compression thus permitting rolling of said sleeping system under both lateral and peripheral compression.

10. A self-supporting outdoor sleeping system as recited in claim 1, wherein:

at least one end portion of said ground cover sheet means is normally forced slightly upwardly from the horizontal by tension force applied thereto by said tent cover, the weight of the user and other objects within said at least one end of said sleeping system forces said slightly upwardly curved end portion downwardly toward the horizontal, thus developing forces increasing the tautness of said tent cover.

11. A self-supporting outdoor sleeping system as recited in claim 1, including:

(a) thermal comforter means being releasably secured to said ground cover sheet means and having a pair of spaced lateral extensions for selected positioning under or about the head and neck of the user as desired for comfort and thermal protection.

12. A self-supporting outdoor sleeping system as recited in claim 1, wherein:

(a) said ground cover sheet means includes a casing panel of heavy duty protective fabric extending along a portion of the length thereof, said casing panel forming the outer protective fabric cover of said sleeping system upon rolling thereof; and (b) compression means being provided on said casing panel and being operative to apply compression forces to the rolled sleeping system upon selective tightening of said compression means.

13. A self-supporting outdoor sleeping system as recited in claim 12, wherein:

(a) one end of said casing panel is of scalloped configuration and is provided with a plurality of buckle members;

(b) a compression panel is secured transversely of said casing panel at an intermediate portion thereof and defines a scalloped portion;

(c) a plurality of compression straps extend from said scalloped portion of said compression panel and are provided with buckles adjustable along the length of said compression straps, with said buckles in assembly said compression straps being tightened to increase peripheral compression of the rolled sleeping system.

14. A self-supporting outdoor sleeping system as recited in claim 1, wherein:

(a) said tent cover defines a plurality of rib receptacles;

(b) said rib means are formed by a plurality of tubular rib sections capable of being assembled in endwise assembly; and (c) an elongate resilient element being extended through said tubular rib sections and retaining said rib sections in end-to-end assembly with one another and with said rib receptacle, said rib sections, when disassembled being positionable in folded relation having a length less than the width of said sleeping system.

15. A self-supporting outdoor sleeping system as recited in claim 1, including:

(a) a removable sheet unit releasably connected to said ground cover sheet means; and (b) said removable sheet unit defining pad pocket means receiving a mattress pad in assembly therewith, whereby the position of said sheet structure and said mattress pad are substantially fixed within said sleeping system relative to said ground cover sheet means.

16. A self-supporting outdoor sleeping system as recited in claim 15, wherein said removable sheet unit comprises:

(a) an elongated sheet panel;

(b) pad pocket means being secured to the underside of said elongated sheet panel and adapted to receive opposite extremities of a generally rectangular mattress pad of suitable thickness for efficient comfort of the user; and (c) means releasably securing opposite sides of said mattress pad to said ground cover sheet.

17. A self-supporting outdoor sleeping system as recited in claim 16, including:

pillow pocket means defined at one end of said elongated sheet panel, said pillow pocket means capable of being stuffed with clothing and other articles to form a pillow for the user.

18. A self-supporting outdoor sleeping system as recited in claim 17, wherein said pillow pocket means extends beyond one of said pad pocket means.

* * * * *